US005248212A

United States Patent [19]

Lhuisset

[11] Patent Number: 5,248,212

[45] Date of Patent: Sep. 28, 1993

[54] DISPENSER WITH VALVE ACTUATED BY A DEFORMABLE WALL THEREOF

[75] Inventor: Francois Lhuisset, Brunoy, France

[73] Assignee: L V M H Recherche, France

[21] Appl. No.: 777,229

[22] PCT Filed: May 4, 1990

[86] PCT No.: PCT/FR90/00321

§ 371 Date: Nov. 5, 1991

§ 102(e) Date: Nov. 5, 1991

[87] PCT Pub. No.: WO90/13234

PCT Pub. Date: Nov. 15, 1990

[30] Foreign Application Priority Data

May 5, 1989 [FR] France ..... 89 05991

[51] Int. Cl.[5] ..... A45D 34/00; A46B 11/00; A65D 37/00

[52] U.S. Cl. ..... 401/186; 222/213; 401/278; 401/279

[58] Field of Search ..... 401/278, 279, 186; 222/213

[56] References Cited

U.S. PATENT DOCUMENTS

| | | | |
|---|---|---|---|
| 172,161 | 1/1876 | Parsons | 222/213 |
| 889,491 | 6/1908 | Tellerson | 272/213 |
| 1,033,861 | 7/1912 | Beck | 222/213 X |
| 1,401,180 | 12/1921 | Nelson | 222/213 |
| 4,867,593 | 9/1989 | Kurokawa et al. | 401/186 |

FOREIGN PATENT DOCUMENTS

| | | | |
|---|---|---|---|
| 0256279 | 2/1988 | European Pat. Off. . | |
| 1432239 | 3/1969 | Fed. Rep. of Germany | 222/213 |
| 8716466 | 2/1988 | Fed. Rep. of Germany . | |
| 1434743 | 4/1966 | France . | |

*Primary Examiner*—Steven A. Bratlie

*Attorney, Agent, or Firm*—Ostrolenk, Faber, Gerb & Soffen

[57] ABSTRACT

The invention relates to a device for the delivery of any type of product held in a reservoir with flexible and deformable wall. The device is essentially comprised of means (4) for the delivery of a product, which means are housed in a reservoir (2) with flexible and deformable wall (3) and which may be actuated by an outside pressure (F) exerted on the deformable wall of the reservoir. The device applies for example to the delivery and application of a cosmetic product on the skin or the nails.

10 Claims, 2 Drawing Sheets

DISPENSER WITH VALVE ACTUATED BY A DEFORMABLE WALL THEREOF

The present invention has essentially as its subject a device for dispensing any product whatsoever contained in a container with a deformable wall.

Tubes forming a container with a deformable wall and susceptible of containing any product whatsoever such as a paste which may be dispensed through an orifice under the effect of a pressure exerted upon the wall of the tube have been on the market for some time.

But such a dispensing device exhibits the disadvantage that the pressure exerted upon the tube is a random one and it often happens that the wall of the tube is damaged and may even become punctured thereby causing leaks of product.

Furthermore containers are known which may contain any product whatsoever which may be dispensed by exerting a pressure upon a mechanical means such, as for instance, a push-button outside of the wall or the container.

But such an external mechanical means is not without its disadvantages. Such a means indeed increases the bulkiness of the container, is very often detrimental to its aesthetic appearance and above all requires the provision of a sealing system which is not always reliable. In addition such a sealing system increases the cost of the container and may promote the seizing of the mechanical means controlling the dispensing of the product.

Therefore the present invention has as its object to overcome in particular the disadvantages mentioned hereinabove by proposing a device which raises no fluid-tightness problem and which allows the deliver of any product whatsoever in an always reliable, precise manner measured in accordance with the pressure applied.

For that purpose the invention has as its subject a device for dispensing any product whatsoever contained in a container with a formable wall and forming a part of a body provided with an orifice adapted to be closed and allowing the delivery of this product, characterized by means for controlling the dispensing of the product, accommodated in the container and operable by an outer pressure exerted upon the deformable wall of this container.

It is therefore understood that the pressure exerted externally upon the deformable wall of the container will cause the delivery of the product through the medium of a control means housed inside of the container and allowing the positive and reliable delivery of a certain amount of product corresponding in a very precise manner to the pressure exerted laterally upon the wall of the container.

According to a first embodiment the aforesaid control means consists of a sector-shaped part which is pivotally mounted in the container on a support integral with the body and which co-operates with a rod actuating a valve susceptible of closing the aforesaid orifice.

The sector-shaped part pushes or pulls the rod against the force of at least one return spring.

According to another characteristic of this device the sector-shaped part is formed of two substantially parallel flanges between which is arranged one end of the aforesaid rod.

According to another embodiment the aforesaid control means is constituted by a push-button disposed inside of the container orthogonally to the axis of the body and meshing with a pinion which is made fast to this body and which itself meshes with teeth carried by a rod actuating a valve susceptible of shutting the aforesaid orifice.

According to still a further embodiment the aforesaid control means are constituted by a movable yoke or U-shaped part the base of which is substantially parallel to the wall of the container and the legs of which are recessed so as to form a ramp co-operating with the end of a rod passing between these legs and actuating a valve susceptible of closing the aforesaid orifice.

The aforesaid U-shaped part slides with its legs orthogonally to the axis of the body in a support made fast to the body.

The supports of the embodiments described hereinabove are preferably made fast to a head comprising the aforesaid orifice and valve and in which the aforesaid rod slides. The fact that the supports are made fast to the head advantageously facilitates the assembly of the different parts of the device upon their being mounted.

Advantageously the valve comprises bristles forming a brush projecting from the aforesaid orifice which allows the product dispensed through the orifice to be applied onto any surface whatsoever such as the skin of the human body or the nails.

Further advantages and characteristics of the invention will be better understood from the detailed description which follows and the annexed drawings given by way of example only and in which.

Figure 2:
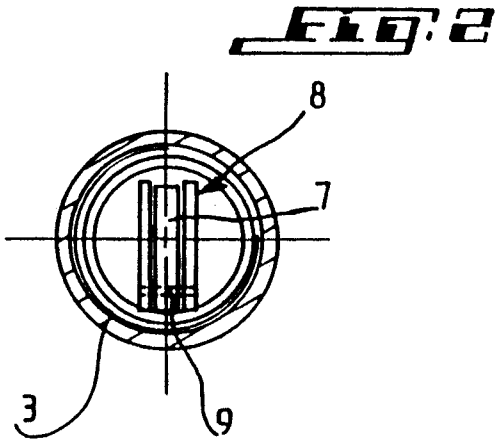
FIG. 2 is a view in section along the line II—II of FIG. 1.
Figure 1:
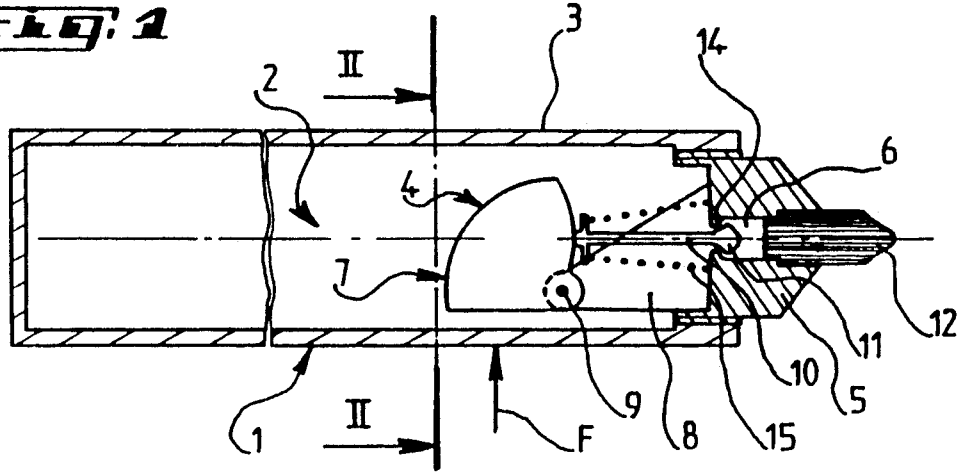
FIG. 1 is diagrammatic view in axial section of a first embodiment of the device according to the principle of the invention and operating by thrust.

Referring to the annexed drawings, and particularly to FIGS. 1 and 2, a dispensing device according to this invention essentially comprises a body 1 forming a container 2 intended to contain any product whatsoever such as for instance a cosmetic product and consisting of a more or less flexible, deformable and preferably elastic wall 3 upon which one may exert an external and manual pressure along the arrow F so as to actuate means 4 for controlling the delivery of the product accommodated in the casing 2.

The body 1 is provided with a head 5 provided with an orifice 6 for the delivery of the product, the head 5 being connected to the wall 3 of the container 2 by any suitable means such as screwing, crimping or molding both elements in one single piece.

Figure 3:
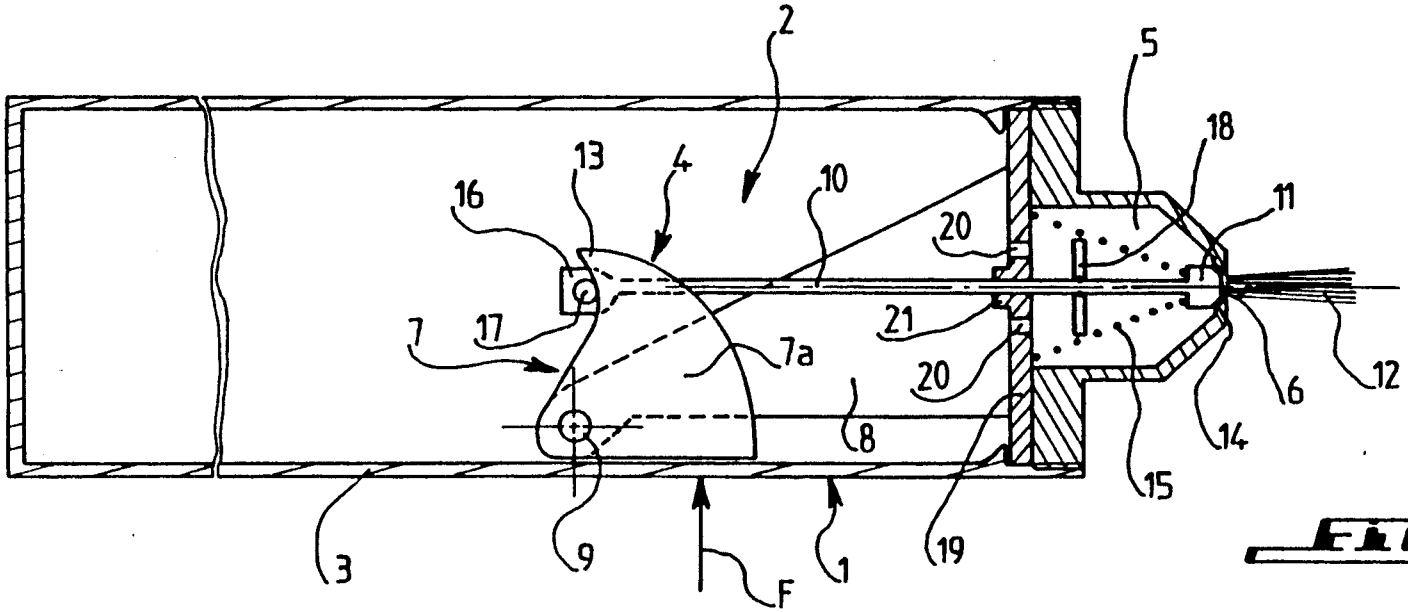
FIG. 3 is a diagrammatic view in axial section of a second embodiment of the device according to the invention and operating through pull.

According to the exemplary embodiments shown in FIGS. 1 and 3 the control means 4 is constituted by a sector-shaped part 7 which is pivotally mounted in the container 2 on a support 8 made fast to the head 5. More precisely the sector 7 is pivotally mounted ar 9 to the support 9 by means of a small pin, for instance. This sector 7 may in the case of the embodiment of FIG. 3 be formed of two flanges 7*a* leaving therebetween a space the function of which will be explained later.

The part 7 co-operates with a rod 10 slidably mounted in the head 5 and carrying a valve 11 made fast to one end of the said rod and susceptible of closing the orifice 6.

The valve 11 may comprise bristles 12 forming in a way a brush for applying the product contained in the casing 2. Instead of using a brush made fast to the valve 11 one could equally use without departing from the scope of the invention a wick which would be made fast either to this valve 11 or to the head 5 as shown on FIG. 1.

In the embodiment of FIG. 1 opposite to the valve 11 the end of the rod 10 bears upon the sector.

Thus, as will be appreciated when referring to FIG. 1, exerting lateral pressure upon the wall 3 of the container 2 along the arrow F, will cause a rocking of the member 7 and hence a thrust upon the rod 10 so that the valve 11 will be disengaged from its seat 14 to allow the delivery of a certain amount of product contained in the casing 2. The thrust of the rod 10 is effected against the compression force of a return spring 15.

Accordingly, by releasing the lateral pressure in a direction opposite to that of the arrow F the sector-shaped member 7 will again assume its position visible in FIG. 1 wherein the valve 11 remains applied onto its seat 14 thus closing the orifice 6.

Although not shown removable plug adapted to be set onto the head 5 could be provided.

The embodiment of FIG. 3 is substantially identical with that of FIG. 1 except that here external pressure upon the sidewall 3 of the container 2 does not effect a thrust but a pull on the rod 10 carrying the valve 11 and this against the force of the spring 15.

More precisely the end 16 of the rod 10 accommodated in the space between the flanges 7*a* of the member 7 carries a small pin 17 retained between these flanges.

As seen, one of the tops of the flanges 7*a* comprises a nose-shaped portion 13 likely to retain the small pin 17.

Also as seen in FIG. 3, the rod Iu includes a stop 18 susceptible of limiting the stroke of this rod upon a pull so as to meter a certain amount of product issuing through the orifice 6. More precisely this stop 17 under the effect of the pull of the rod 10 co-operates with the base portion 19 for the connection or the head 5 to the container 2, which base portion comprises openings 20 for the passage of the product and a bearing 21 allowing the guided sliding of the rod 10. The stop 18 upon closing the openings 20 advantageously controls delivery of the product issuing through said openings.

Figure 4:
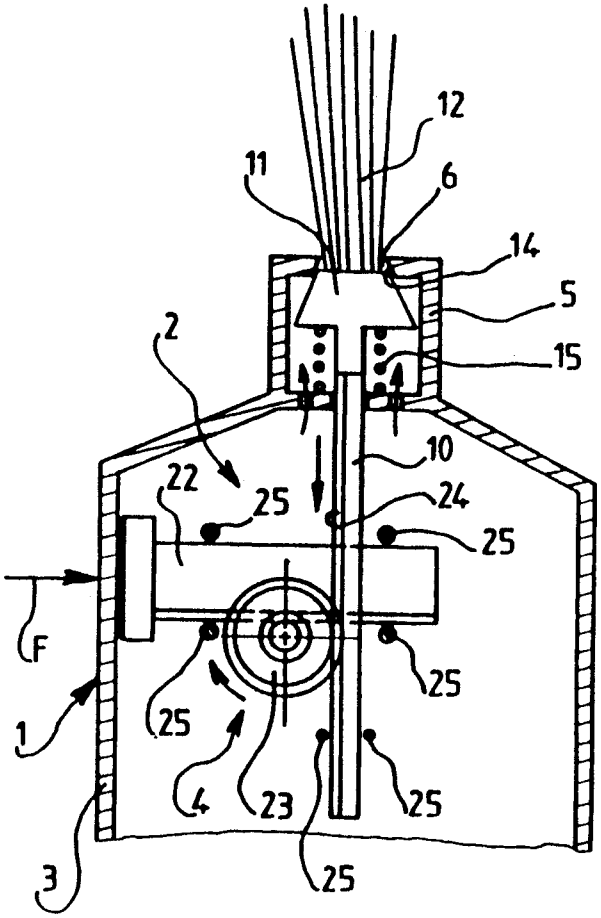
FIG. 4 is a diagrammatic partial view in axial section of still another embodiment of the device according to the principle of the invention.

According to the alternative embodiment of FIG. 4 the means 4 for controlling the delivery of the product contained in the casing 2 essentially comprises a push-button disposed inside of this container orthogonally to the axis of the body 1 and meshing with a pinion 23 which is made fast to this body and which meshes with teeth 24 carried by the rod 10 actuating the valve 11. The pinion teeth gear ratio is of course selected in a suitable manner for adjusting the stroke of the rod 10.

Diagrammatically shown at 25 are elements for guiding the push-button 22 and the roll 10 which is also slidably mounted in the head 5, it being understood that as in the previous embodiments that the valve 11 carried by the rod 10 is accommodated in the head 5 and is constantly biased by a spring 15.

The operation follows straightforwardly from the foregoing description.

By a thrust along the arrow F upon the wall 3 of the container 2 the push-button 22 is actuated which through the medium of the pinion 23 makes the rod 10 move downwards against the force of the return spring 15 so that the valve 11 is disengaged from its seat 14, seen in FIG. 4.

By releasing the pressure along the arrow F the spring 15 will bring the valve 11 back onto its seat 14 thereby causing the rotation of the pinion 23 in the reverse direction and therefore the placing of the push-button 22 back to its position near the inner wall of the container 2 so that the apparatus will be ready for a new delivery of product by pressing again upon the sidewall of the container according to the arrow F.

Figure 5:
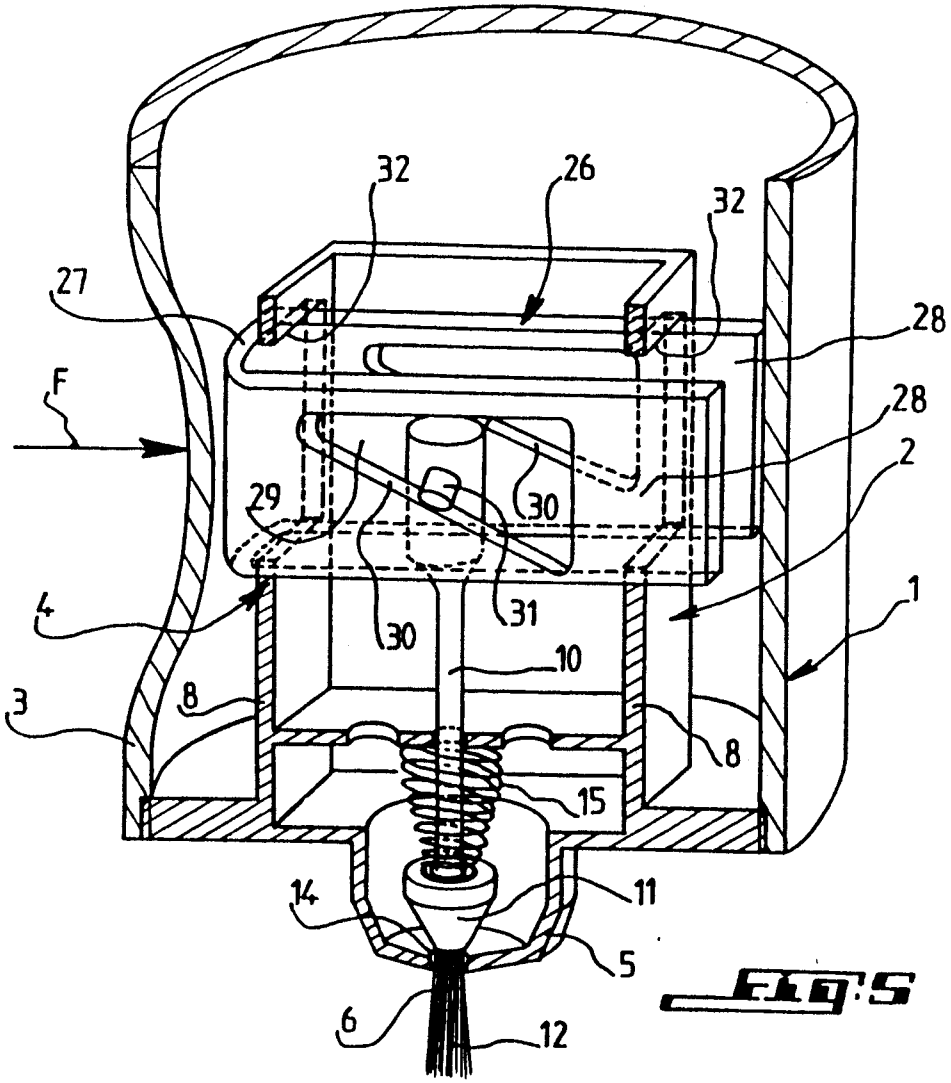
FIG. 5 is a perspective view in axial section of still another embodiment of the dispensing device according to this invention illustrated in open position for delivering a product.

According to the embodiment shown in FIG. 5 the means 4 for operating the rod 10 is essentially constituted by a movable yoke or U-shaped part 26 the base 27 of which is substantially parallel to the wall 3 of the container 2 and both legs 28 of which each define a recess 29 forming a ramp 30 co-operating with a small cross pin 31 made fast to the end of the rod 10 opposite to that carrying the valve 11.

The U-shaped member 26 is slidably mounted with its legs 28 orthogonally to the axis of the body 1 in a support 8 in the form of a polygonal sleeve through which is formed an elongated transverse opening 32 slidably receiving and guiding the member 26.

In operation, an external pressure upon the flexible and deformable wall 23 of the container 2 according to the arrow F as viewed in FIG. 5 will actuate the member 26 transversely which will cause, owing to the ramp 30, the displacement of the rod 10 against the force of the return spring 15 so that the valve 11 will be disengaged from its seat 14 and some products will be dispensed through the orifice 6 of the head 5.

Upon releasing the pressure according to the arrow F, under the effect of the force of the spring 15, the small pin 31 will move downwards along the ramp 30 so that the valve 11 will close the orifice 6, it being understood that the base 27 of the U-shaped member 26 will follow the wall 3 of the container 2 in its deformation. Hence the apparatus will be ready for a new delivery and/or applying of the product.

The invention is of course not at all limited to the embodiments described and illustrated which have been given by way of example only.

Thus the material constituting the body of the apparatus may be of any suitable compositions such as polyethylene, as can be the various members of the control mechanism inside of the container, it being understood that in this respect a synthetic material will be preferred. Likewise the configuration of the sector-shaped part may be any one appropriate with the viscosity of the product contained in the container. This part may also have any suitable shape whatsoever at its portion which will be in contact with the inner wall of the container when one exerts a pressure upon the outside of this container for dispensing some product.

It should also be noted that in some embodiments such as those shown on FIGS. 3, 4 and 5 the applying end constituted by the brush, the wick or the like may penetrate into the inside of the head 5 from the retraction of the rod 10. This offers the advantage of promoting the impregnation of the applying end by the product. Moreover, the device according to this invention is particularly suitable to the delivery of visquous liquids such as for example nail varnish. In this respect one may use as a material constituting the deformable and elastic wall of the body 1 a composite plastics material such as that known under trade name "SELAR RB" available at KAUTEX WERKER, Bonn (German Federal Republic) and which is consistent with the solvent used in the formula of the nail varnish and which is also impervious to the vapors of these solvents.

I claim:

1. A dispenser for the delivery of a product, comprising:

a container for containing the product, the container having a deformable sidewall and a selectively open and closeable orifice through which the product may be delivered;

a rod having a valve at one end, the rod being movable from a first position in which the valve is in engagement with the orifice to close the same to a second position in which the valve is out of engagement with the orifice and the orifice is open;

a sector-shaped part pivotally mounted in the container for moving the rod by camming action from the first position to the second position on pivoting of the sector-shaped part in a first direction, the sector-shaped part being pivoted in the first direction by lateral deformation of the sidewall resulting from lateral pressure being applied to only one side of the wall; and a spring connected to the rod for returning the rod to the first position upon removal of the lateral pressure.

2. A dispenser as in claim 1 in which the sector-shaped part is arranged relative to the rod such that the sector-shaped part on pivoting in the first direction pushes the rod from the first position to the second position thereof.

3. A dispenser as in claim 1 in which the sector-shaped part is arranged relative to the rod such that it pulls the rod from the first to the second position upon pivoting of the sector-shaped part in the first direction.

4. A dispenser as in claim 3 in which the sector-shaped part is formed of two substantially parallel flanges and the end of the rod opposite the end at which the valve is located is positioned between said flanges.

5. The dispenser of claim 1, in which the sector-shaped part is pivoted on a support element fixedly connected to the container.

6. The dispenser of claim 5, in which the container has a head portion, the orifice is located in the head portion and the support element is fixedly connected to the head portion.

7. The dispenser of claim 1 further including bristles forming a brush connected to the valve and projecting from the orifice.

8. A dispenser for the delivery of a product, comprising:

a container for containing the product, the container having a sidewall, a longitudinal axis and a selectively openable and closeable orifice through which the product may be delivered;

a rod having teeth disposed thereon and a valve at one end thereof for closing and opening the orifice, the rod being movable in the direction of the longitudinal axis of the container from a first position in which the valve is in engagement with the orifice to close the same a second position in which the valve is out of engagement with the orifice and the orifice is open;

a push button disposed inside of a container orthogonally to the longitudinal axis of the container, the push button having a pinion fixed thereto and in mesh with the teeth of the rod so that upon lateral deformation of the sidewall of the container, the push button moves laterally to cause the pinion to move the rod from the first position thereof to the second position.

9. A dispenser for the delivery of a product, comprising:

a container for containing the product, the container having a deformable sidewall, a longitudinal axis and a selectively openable and closeable orifice through which the product may be delivered;

a U-shaped member having a base and a pair of legs, each of which has an opening defining a ramp;

a rod having a valve at one end thereof, the other end of the rod extending between and through the openings of the legs of the U-shaped member in engagement with the ramps thereof, the rod being movable in the direction of the longitudinal axis from a first position in which the valve is in engagement with the orifice and the orifice is closed to a second position in which the valve is out of engagement with the orifice and the orifice is open; and the U-shaped member being movable upon deformation of the sidewall by the exertion of lateral pressure thereon to cause the rod to move by camming action from its first position to the second position thereof.

10. The dispenser of claim 9, further including a support fixedly connected to the container for slidably supporting the U-shaped member with the legs thereof orthogonal to the longitudinal axis of the container.

* * * * *